US005923723A

United States Patent [19]

Herbst

[11] Patent Number: 5,923,723

[45] Date of Patent: Jul. 13, 1999

[54] HIGH-VOLTAGE GENERATOR FOR AN X-RAY GENERATOR

[75] Inventor: Ludwig Herbst, Eggolsheim, Germany

[73] Assignee: Siemens Aktiengesellschaft, Munich, Germany

[21] Appl. No.: 08/906,299

[22] Filed: Aug. 5, 1997

[30] Foreign Application Priority Data

Aug. 19, 1996 [DE] Germany ..... 196 33 357
Feb. 19, 1997 [DE] Germany ..... 197 06 550

[51] Int. Cl.[6] ..... H05G 1/10

[52] U.S. Cl. ..... 378/101; 378/201

[58] Field of Search ..... 378/101, 201

[56] References Cited

U.S. PATENT DOCUMENTS 4,694,480 9/1987 Skillicorn ..... 378/102
5,363,286 11/1994 Tsuchiya .
5,517,545 5/1996 Nakamura et al. ..... 378/101

*Primary Examiner*—Craig E. Church
*Attorney, Agent, or Firm*—Hill & Simpson

[57] ABSTRACT

A high-voltage generator having components cast in a casting compound is in use flexible and service-friendly. The high-voltage generator has an anode side module and a cathode side module with respective components of these modules at the high-voltage side being cast in a casting compound. The primary windings and the cores are externally arranged.

5 Claims, 1 Drawing Sheet

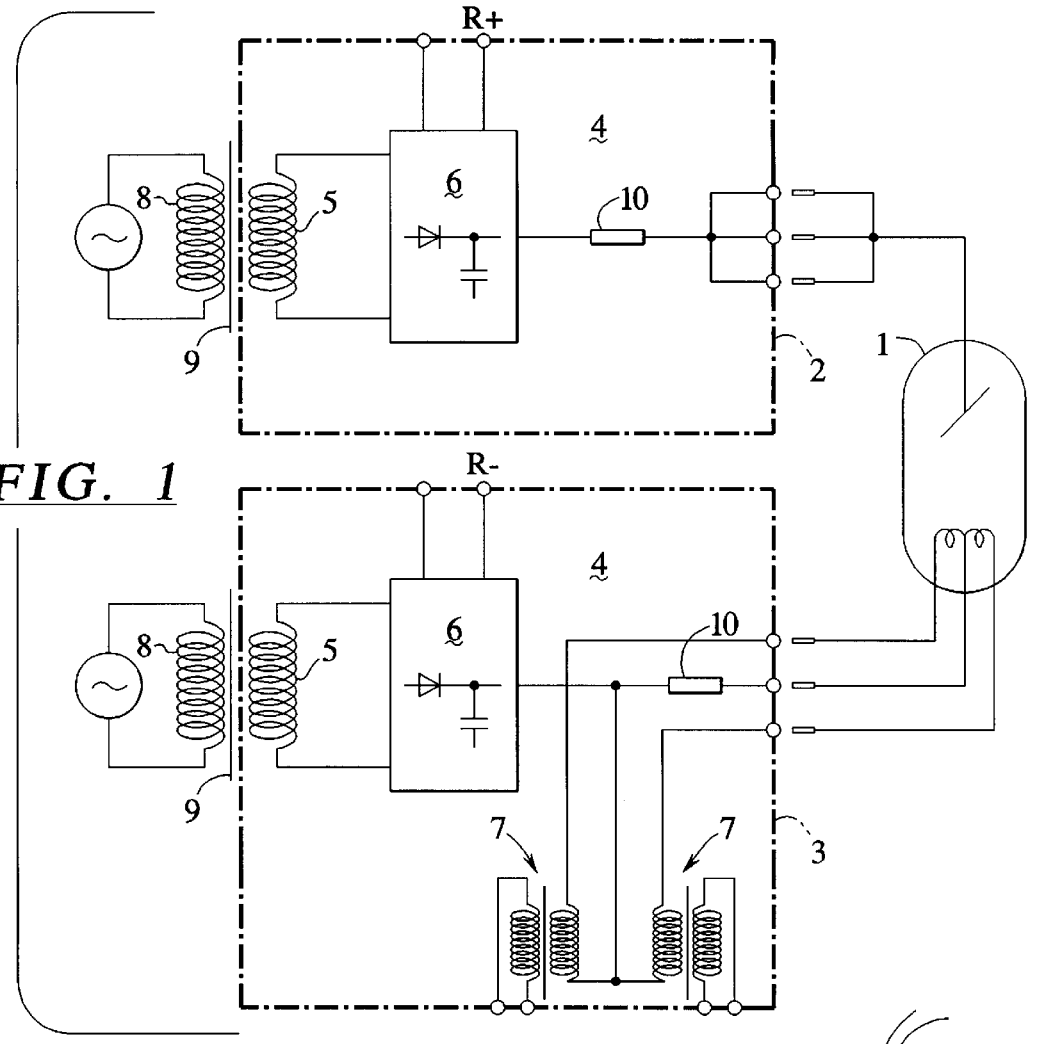
FIG. 1
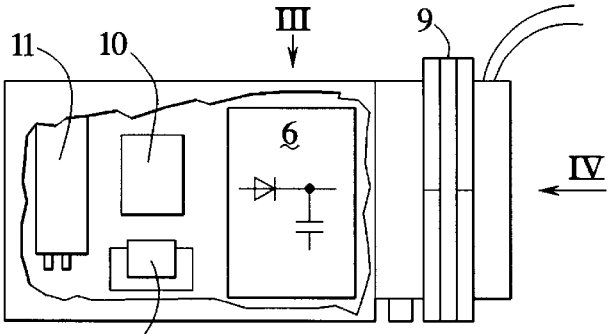
FIG. 2
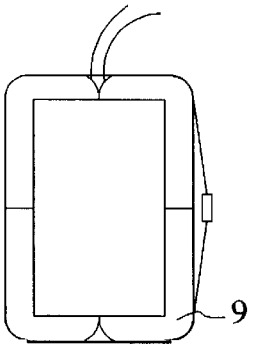
FIG. 4
FIG. 3
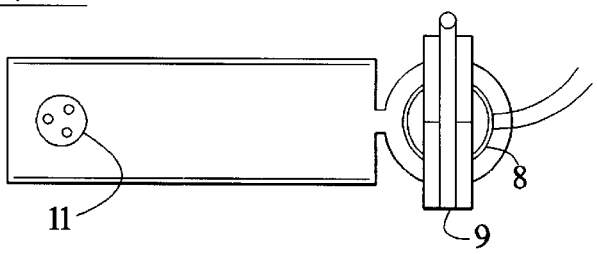

HIGH-VOLTAGE GENERATOR FOR AN X-RAY GENERATOR

BACKGROUND OF THE INVENTION

1. Field of the Invention

The present invention is directed to a high-voltage generator suitable for feeding an X-ray source in an X-ray generator.

2. Description of the Prior Art

High-voltage generators that contain a high-voltage transformer in an oil-filled tank are employed in X-ray technology. The oil serves the purpose of insulating the high-voltage transformer as well as other components, for example the filament transformer, arranged in the tank accepting the high-voltage transformer from diodes, capacitors, etc.

U.S. Pat. No. 5,363,286 A discloses a high-voltage generator for an X-ray generator wherein all components of the high-voltage generator are cast into and insulated by a casting compound. Given a fault of a single component, the entire high-voltage generator must be replaced because the malfunctioning component cannot be extracted.

SUMMARY OF THE INVENTION

An object of the present invention is to provide a high-voltage generator, in particular for supplying an X-ray generator, whose components are insulated by a casting compound which can be more flexibly utilized and which is more beneficial in terms of maintenance.

This object is inventively achieved in a high-voltage generator and is constructed in modular fashion, i.e. an anode-side module and a cathode-side module are provided, whose components subject to high-voltage are cast (potted) in insulated casting compound. Given a fault, only the faulty module, rather than the entire high-voltage generator, has to be replaced. Further, one module by itself, namely the module of the anode-side, can also be utilized as a single-pole high-voltage generator, for example for a mammography apparatus.

In an embodiment, the primary coil and the core of the high-voltage transformer are arranged externally of a module, i.e. are not cast. As a result, the primary side can be changed while retaining the existing secondary side. A plug-in coupling for the connection of a plug for the power supply can be worked into the casting compound, i.e. can be a component past of the casting.

DESCRIPTION OF THE DRAWINGS

FIG. 1 is a circuit diagram of a high-voltage generator of the invention.

FIG. 2 is a side view partly broken away, of a module of a high-voltage generator of the invention.

FIG. 3 is a view as seen in the direction of the arrow III in FIG. 2.

FIG. 4 is a view as seen in the direction of the arrow IV in FIG. 2.

DESCRIPTION OF THE PREFERRED EMBODIMENTS

FIG. 1 shows an X-ray tube 1 that is supplied by two modules 2 and 3 of a high-voltage generator. Each of the modules 2 and 3 contains components of the high-voltage side of the high-voltage generator, the components being cast (potted) in a plastic casting compound 4. The components in each module 2 and 3 include the secondary winding 5 of a high-voltage transformer and a following high-voltage rectifier 6. The module 3 additionally has two filament transformers 7 cast in the casting compound. The high-voltage rectifiers 6 are connected in series for producing the high-voltage for the X-ray tube 1. Terminals are conducted toward the exterior from the rectifiers 6 and the transformers 7. An external base impedance that is not cast,t can be connected to the terminal R+ or to R− for individual adaptation of a precision divider for the high-voltage measurement.

It is important that the primary windings 8 of the high-voltage transformers as well as their cores 9 lie outside the casting compound 4.

FIGS. 2 through 4 show the module 3 in greater detail. The core 9 is composed of a number of parts that are pushed over the external primary winding 8. The secondary winding 5 is cast in a casting compound, as are the other components visible in FIG. 2, namely attenuation resistors 10, the filament transformer 7 and the high-voltage rectifier 6. A depression 11 that serves as plug socket for a plug mating therewith is also formed in the casting compound 4.

The module 2 is constructed analogously to the module shown in FIG. 2 through 4, but contains no filament transformer.

The modular structure of the high-voltage generator, i.e. by means of two separate modules 2 and 3 for the anode and cathode of the X-ray tube 1, has the following advantages: Given a fault, only the corresponding module, but not the entire high-voltage generator, need be replaced. A better heat elimination due to a larger surface is achieved compared to a single, compact structure. The module 2 can also be employed by itself as a single-pole high-voltage generator. The assembly is simplified because of the relatively low weight of each of the modules 2 and 3.

The external arrangement of the primary windings 8 and of the cores 9 has the following advantages: The components can be recycled given waste disposal. An individual adaptation of the primary side of the anode-side module 2 and the cathode-side module 3 is possible. Using the same secondary side, the primary side can be varied, thereby enabling type and power matching. The thermal loses in the primary windings 8 and in the cores 9 do not stress the casting compound 4.

The shaping of the depression 11 into the casting compound 4 as plug socket has the advantage that a separate component is not required therefor, allowing conventional plugs to be employed.

The thermal conductivity of the casting compound is increased by appropriate fillers in the casting compound 4, for example aluminum oxide or aluminum hydroxide.

Given a corresponding shaping of the casting mold, cooling ribs can be easily realized on the surface of the modules 2 and 3.

A conductive lacquer can be employed as a release agent to free the casting from the mold. After the casting process, the high-voltage generator is thus already conductively coated.

The overall high-voltage generator composed of the modules 2 and 3 is independent of orientation during transport and during use. It can be built into a generator cabinet (housing) upon manufacture, so that only the connection to the X-ray tube 1 ensues at the user location.

Although modifications and changes may be suggested by those skilled in the art, it is the intention of the inventor to embody within the patent warranted hereon all changes and modifications as reasonably and properly come within the scope of his contribution to the art.

I claim as my invention:

1. A high-voltage generator for feeding an X-ray tube in an X-ray generator comprising:

a housing;

a plurality of electrical components comprising an anode side of said high-voltage generator, including a high-voltage anode side transformer having a primary winding and a secondary winding;

a first module comprising said plurality of components comprising said anode side cast in casting compound, except for said primary winding of said anode side transformer, said secondary winding of said anode side transformer being cast in said first module and said first module having an opening therein adjacent said secondary winding of said anode side transformer, said primary winding of said anode side transformer being disposed in said housing adjacent said opening and outside of said first module for inductive interaction with said secondary winding of said anode side transformer;

a plurality of electrical components comprising a cathode side of said high voltage generator, including a high-voltage cathode side transformer having a primary winding and a secondary winding;

a second module, separate from said first module, comprising said plurality of components comprising said cathode side cast in casting compound, except for said primary winding of said cathode side transformer, said secondary winding of said cathode side transformer being cast in said second module and said second module having an opening therein adjacent said secondary winding of said cathode side transformer, said primary winding of said cathode side transformer being disposed in said housing adjacent said opening and outside of said second module for inductive interaction with said secondary winding of said cathode side transformer; and said first and second modules being disposed in said housing for insulating said components comprising said anode side from said components comprising said cathode side.

2. A high-voltage generator as claimed in claim 1 further comprising a filament transformer, and wherein said second module also comprises said filament transformer cast in said casting compound.

3. A high-voltage generator as claimed in claim 1 wherein each of said first and second modules further comprises a conductive lacquer coating covering the casting compound.

4. A high-voltage generator as claimed in claim 1 wherein the casting compound of each of said first and second modules comprises a casting compound containing additives for increasing a thermal conductivity of said casting compound.

5. A high-voltage generator as claimed in claim 1 wherein each of said first and second modules has an external depression cast therein forming a plug socket for receiving a plug for supplying power to the plurality of electrical components cast therein.

* * * * *